US008424154B2

(12) United States Patent
Beskow et al.

(10) Patent No.: US 8,424,154 B2
(45) Date of Patent: Apr. 23, 2013

(54) VACUUM CLEANER WITH FILTER CLEANING MEANS

(75) Inventors: Jonas Beskow, Stockholm (SE); Håkan Miefalk, Järfälla (SE)

(73) Assignee: AB Electrolux, Stockholm (SE)

( * ) Notice: Subject to any disclaimer, the term of this patent is extended or adjusted under 35 U.S.C. 154(b) by 884 days.

(21) Appl. No.: 12/296,864

(22) PCT Filed: Apr. 10, 2007

(86) PCT No.: PCT/SE2007/000334

§ 371 (c)(1),
(2), (4) Date: Sep. 21, 2009

(87) PCT Pub. No.: WO2007/117196

PCT Pub. Date: Oct. 18, 2007

(65) Prior Publication Data

US 2010/0024154 A1 Feb. 4, 2010

(30) Foreign Application Priority Data

Apr. 10, 2006 (SE) ..... 0600820

(51) Int. Cl.
*A47L 9/10* (2006.01)

(52) U.S. Cl.
USPC ..... 15/352; 15/DIG. 8; 55/288; 55/334; 55/361; 55/DIG. 2; 55/DIG. 3

(58) Field of Classification Search ..... 15/352, 15/DIG. 8; 55/288, 334, 361, DIG. 2, DIG. 3; *A47L 9/10*
See application file for complete search history.

(56) References Cited

U.S. PATENT DOCUMENTS

| | | | | |
|---|---|---|---|---|
| 2,558,429 | A | 6/1951 | Gerber | |
| 2,621,757 | A | 12/1952 | Anderson | |
| 2,707,792 | A | 5/1955 | Waller | |
| 2,863,524 | A | 12/1958 | Buda | |
| 3,199,138 | A | 8/1965 | Nordeen | |
| 3,621,640 | A | 11/1971 | Ohno et al. | |
| 3,653,189 | A * | 4/1972 | Miyake et al. | 55/288 |
| 3,906,219 | A | 9/1975 | Stauffer | |
| 4,213,224 | A | 7/1980 | Miller | |

(Continued)

FOREIGN PATENT DOCUMENTS

| | | |
|---|---|---|
| CA | 2087056 | 7/1994 |
| CN | 1272873.X | 1/2003 |

(Continued)

OTHER PUBLICATIONS

"The BOSS, Heavy Duty Rechargeable Vacuum, Model 98," Eureka brochure dated 1998, 2 pages.
Fakir product pages catalogue, 2002 (5 pages).
Black & white printouts of http://www.igia.com/prodetail.cfm?ID=AT7290 "IGIA Vac Blue", 2002 (3 pages).
Black & white printouts of http://www.igia.com/prodetail.cfm?ID=AT7691 "Wind Storm Wet/Dry Vacuum", 2002 (1 page).

(Continued)

*Primary Examiner* — David Redding
(74) *Attorney, Agent, or Firm* — Hunton & Williams LLP

(57) ABSTRACT

A vacuum cleaner having a housing with a dust container having an inlet for dust laden air, a filter unit comprising a flexible filter body, a motor fan unit for generating a flow of air through the inlet and through the filter unit, and a dust removing means configured to agitate the flexible filter body in response to a force applied to the dust removing means.

19 Claims, 5 Drawing Sheets

U.S. PATENT DOCUMENTS 4,276,070 A 6/1981 Hug
4,376,322 A 3/1983 Lockhart et al.
4,421,964 A 12/1983 Buchtel
4,467,493 A 8/1984 Buchtel
4,541,142 A 9/1985 Pudwill
4,545,089 A 10/1985 Oxel
4,573,234 A 3/1986 Kochte et al.
4,573,237 A 3/1986 Kochte et al.
4,621,390 A 11/1986 Hampton et al.
4,635,315 A 1/1987 Kozak
4,665,582 A 5/1987 Richmond et al.
4,670,701 A 6/1987 Sako et al.
4,704,765 A 11/1987 Ataka
4,748,713 A 6/1988 Sepke et al.
4,766,638 A 8/1988 McDowell
4,787,923 A 11/1988 Fleigle et al.
4,804,481 A 2/1989 Lennartz
D300,214 S 3/1989 Adams
4,821,366 A 4/1989 Levine
4,831,685 A 5/1989 Bosyj et al.
4,841,594 A 6/1989 Elson et al.
D304,104 S 10/1989 Busalt et al.
4,876,763 A 10/1989 Cho et al.
4,894,882 A 1/1990 Toya
4,899,418 A 2/1990 Steiner et al.
D307,657 S 5/1990 Li
4,920,606 A 5/1990 Gerke, Jr. et al.
4,920,608 A 5/1990 Hult et al.
4,928,346 A 5/1990 Elson et al.
4,934,020 A 6/1990 Jackson
4,942,641 A 7/1990 Gerke, Jr. et al.
4,947,514 A 8/1990 Gerke, Jr. et al.
4,967,443 A 11/1990 Krasznai et al.
4,993,106 A 2/1991 Hult et al.
5,005,252 A 4/1991 Steiner et al.
5,020,187 A 6/1991 Kosten et al.
5,025,529 A 6/1991 Hult et al.
5,035,024 A 7/1991 Steiner et al.
5,065,473 A 11/1991 Krasznai et al.
5,107,567 A 4/1992 Ferrari et al.
5,309,600 A 5/1994 Weaver et al.
5,322,534 A 6/1994 Kaiser
5,342,433 A 8/1994 Avondoglio
D352,807 S 11/1994 Sanderud
D364,013 S 11/1995 Klingspor et al.
5,524,321 A 6/1996 Weaver et al.
5,561,885 A 10/1996 Zahuranec et al.
5,584,095 A 12/1996 Redding et al.
5,603,740 A 2/1997 Roy
5,661,885 A 9/1997 Donato
5,704,956 A * 1/1998 Loveless et al. ..... 55/305
5,715,566 A 2/1998 Weaver et al.
5,733,351 A 3/1998 Hult et al.
5,819,364 A 10/1998 Sham
5,869,947 A 2/1999 Zahuranec et al.
5,966,774 A 10/1999 Bone et al.
6,029,313 A 2/2000 O'Dea et al.
6,094,775 A 8/2000 Behmer
6,108,864 A 8/2000 Thomas et al.
6,122,796 A 9/2000 Downham et al.
6,125,498 A 10/2000 Roberts et al.
6,131,239 A 10/2000 White
6,146,434 A 11/2000 Scalfani et al.
6,189,178 B1 2/2001 Roberts
6,311,366 B1 11/2001 Sepke et al.
6,324,714 B1 12/2001 Walz et al.
6,428,589 B1 8/2002 Bair et al.
6,434,785 B1 8/2002 Vandenbelt et al.
6,546,592 B1 4/2003 Cockburn et al.
6,562,093 B2 5/2003 Oh
6,571,421 B1 6/2003 Sham et al.
6,625,845 B2 9/2003 Matsumoto et al.
6,647,587 B1 11/2003 Ohara et al.
6,658,693 B1 12/2003 Reed, Jr.
6,736,873 B2 5/2004 Conrad et al.
6,766,558 B1 7/2004 Matsumoto et al.
6,775,882 B2 8/2004 Murphy et al.
6,811,584 B2 11/2004 Oh
6,824,580 B2 11/2004 Oh
6,839,934 B2 1/2005 Houghton et al.
6,857,165 B2 2/2005 Oh
6,928,690 B2 8/2005 Ji
6,948,211 B2 9/2005 Stephens et al.
6,964,082 B2 11/2005 Hsu
6,968,596 B2 11/2005 Oh et al.
7,377,007 B2 5/2008 Best
7,383,609 B2 6/2008 Ji
7,386,916 B2 6/2008 Bone
7,404,838 B1 7/2008 Pathak
7,412,749 B2 8/2008 Thomas et al.
7,507,269 B2 3/2009 Murphy et al.
7,845,046 B2 * 12/2010 Milligan et al. ..... 15/352
2002/0042969 A1 4/2002 Nagai et al.
2002/0073504 A1 6/2002 Hall et al.
2002/0189048 A1 12/2002 Maruyama et al.
2003/0019073 A1 1/2003 Oh
2003/0159235 A1 8/2003 Oh
2003/0163887 A1 9/2003 Inoue
2003/0208879 A1 11/2003 Oh et al.
2003/0213091 A1 11/2003 Oh et al.
2004/0040270 A1 3/2004 Inoue et al.
2004/0098957 A1 5/2004 Yoo et al.
2004/0103496 A1 6/2004 Worwag
2004/0134022 A1 7/2004 Murphy et al.
2004/0177471 A1 9/2004 Jung et al.
2004/0187253 A1 9/2004 Jin et al.
2004/0200029 A1 10/2004 Jin et al.
2004/0216263 A1 11/2004 Best
2004/0261212 A1 12/2004 Park et al.
2004/0261213 A1 12/2004 Park et al.
2005/0005390 A1 1/2005 Lee et al.
2005/0005391 A1 1/2005 Park
2005/0081321 A1 4/2005 Milligan et al.
2005/0125939 A1 6/2005 Hansen et al.
2005/0125940 A1 6/2005 McDowell
2005/0132528 A1 * 6/2005 Yau ..... 15/344
2005/0183406 A1 8/2005 Coburn
2006/0064828 A1 3/2006 Stein et al.
2006/0090290 A1 * 5/2006 Lau ..... 15/344
2006/0156508 A1 7/2006 Khalil
2007/0163075 A1 * 7/2007 Butler et al. ..... 15/410
2007/0271724 A1 11/2007 Hakan et al.

FOREIGN PATENT DOCUMENTS

DE G 79 29 844.5 3/1981
DE 32 28 491 A1 2/1984
DE 33 09 162 A1 9/1984
DE 33 25 336 1/1985
DE 8623004 10/1986
DE 37 43 083 A1 6/1989
DE G 90 10 066.2 10/1991
DE G 91 14 371.3 4/1992
DE 4038262 6/1992
DE 19630286 1/1998
DE 10110581 11/2001
DE 10124216 1/2002
EP 0 170 720 2/1986
EP 0 215 619 A2 3/1987
EP 0 827 710 A2 3/1998
EP 0 853 917 7/1998
EP 0914795 A2 12/1999
EP 1 070 478 1/2001
EP 1 224 898 7/2002
EP 1 279 362 1/2003
FR 2603181 6/1987
GB 107637 7/1917
GB 857580 12/1960
GB 990065 4/1965
GB 1201841 8/1970
GB 2035787 A 6/1980
GB 2137896 10/1984
GB 2155314 9/1985
GB 2189382 A 10/1987
GB 2268875 1/1994
GB 2291790 7/1994
GB 2 349 105 10/2000
GB 2 372 434 8/2002

| | | | |
|---|---|---|---|
| GB | 2398486 | A | 8/2004 |
| GB | 2413942 | | 11/2005 |
| JP | 50-150340 | | 12/1975 |
| JP | 54-100149 | | 8/1979 |
| JP | 3-267032 | | 11/1991 |
| JP | 4364822 | | 12/1992 |
| JP | 2000-070198 | | 3/2000 |
| JP | 2001-095735 | | 4/2001 |
| JP | 2001353110 | | 12/2001 |
| JP | 2002 085297 | A | 3/2002 |
| JP | 2002 136456 | A | 5/2002 |
| JP | 2003 275154 | A | 9/2003 |
| SE | 514314 | C2 | 3/1998 |
| SE | 510283 | C2 | 10/1998 |
| WO | WO 97/20492 | | 6/1997 |
| WO | WO 03/009736 | | 2/2003 |
| WO | WO 2004/069021 | | 8/2004 |
| WO | WO 2005/111084 | | 11/2005 |

OTHER PUBLICATIONS

Black & white printouts of http://www.igia.com/prodetail.cfm?ID=AT7739 "Wind Storm Vacuum", 2002 (3 pages).

Black & white printouts of http://www.sewserg.com/products/abp02698.html Miele S147 Little Giant Plus Vacuum Cleaner with Free 5 YR Extended Warranty/Replacement. 1995 (3 pages).

Black & white printouts of http://www.sewserg.com/products/abp09802-0775.html "Wind Storm AT7813 3in1 Upright, Stick & Hand Held Bagless Vacuum Cleaner Windstorm, 4 Attachments, Fold Down Handle for Storage, Weighs under 8 Pounds", 1995 (3 pages).

Black & white printouts of http://www.zweita.net/ "Product Info", 2003 (3 pages).

* cited by examiner

VACUUM CLEANER WITH FILTER CLEANING MEANS

The present invention claimes priority to International Application No. PCT/SE2007/000334 filed Apr. 10, 2007, which claims priority to Swedish Application No. SE 0600820-5 filed Apr. 10, 2006. The entire disclosures of all of the foregoing are incorporated herein by reference.

TECHNICAL FIELD

The present invention relates to a hand held vacuum cleaner comprising a housing, a dust container, a motor fan unit and a filter unit.

BACKGROUND ART

Vacuum cleaners are commonly used in households for removing dust and debris from various surfaces, and today it is essential that the vacuum cleaner be easy to use, easy to clean and versatile in respect of fields of application.

Generally, a vacuum cleaner has a filter for removing dust from dust laden air flowing through the vacuum cleaner. After some time of usage dust adheres to the filter surface which leads to a pressure drop and reduced vacuum cleaning efficiency. Thus, cleaning of the filter is necessary to remove the particulate matter, such as dust, hair and fibers, from the filter.

In case of a clogged filter, it is also common to replace the filter with a new one for regaining vacuum cleaning efficiency. WO 2004/069021 discloses a hand held vacuum cleaner having housing incorporating a motor fan unit. A dust container is connected to the housing, and when the vacuum cleaner is operated, dust laden air flows through an inlet, into the dust container, through a filter for trapping dust, and thereafter past the motor fan unit and out through air outlets. After operation, fine dust is clogged-to the filter, and sucked up debris is trapped in the dust container.

The dust container is emptied by letting out trapped debris through a dust outlet opening. Another way of emptying the dust container involves removing the dust container, removing the filter from the dust container and letting out debris through a hole previously covered by the removed filter. The filter is cleaned by manually shaking or brushing the filter, or by vacuum cleaning the filter with another vacuum cleaner.

The filter cleaning process for the described vacuum cleaner is rather cumbersome. Moreover, dust removed from the filter is often uncontrollably spread to the surroundings.

SUMMARY OF THE INVENTION

It is an object of the present invention to provide an improvement of the above techniques and prior art.

These and other objects as well as advantages that will be apparent from the following description of the present invention are-achieved by a hand held vacuum cleaner having the features of appended claim 1.

The hand held vacuum cleaner according to the invention is advantageous since the dust removing means cause adhered dust to fall off the filter when the dust removing means collapes and expands the filter body. The dust removing means may be configured to be manually operated, which provides a simple structure allowing a user to operate the dust removing means. The dust removing means may further comprise an elastic element which continuously exerts a force on a portion of the filter unit, for the purpose of providing an effective way of expanding the flexible filter body. The dust removing means may comprise a rod connected to a bottom portion of the filter unit, and the rod may be movable in a direction from that portion of the filter unit to an opposite portion of the filter unit. This embodiment is cost efficient in terms of production and contributes to a low overall cost for the implementation of the present invention.

The vacuum cleaner according to the invention may comprise an elastic element which continuously exerts a force on the rod for expanding the flexible filter body and for providing efficient cleaning of the filter.

The filter unit may comprise an attachment member for attaching the filter unit to any of the housing and the dust container, which provides a fast and user friendly attachment of the filter unit. The aforementioned attachment member may support the dust removing means, and the filter unit and the dust removing means may form an integrated and exchangeable filter assembly. These arrangements provide for a fast, combined and automated manufacturing process for the filter and/or the dust removing means, as well as convenient handling of the filter unit.

The attachment member and the flexible filter body may be integrated which is advantageous since a more efficient filter manufacturing process is facilitated.

The flexible filter body may be essentially tubelike with one closed end and one open end opposite the closed end, for providing an efficient dust trapping filter shape.

The flexible filter body may have a sleek surface facing the interior of the dust container, which allows, for example, hair and fibers to more easily fall off the filter.

The filter unit may comprise a coarse pre-filter body at least partially encompassing the flexible filter body, which allows coarse particles such as fibers and hair to be trapped by the coarse filter, while the flexible filter body which is arranged downstream of the coarse filter body traps finer particles of dust.

The coarse pre-filter body may have an opening for conveniently letting out dust when cleaning the filter unit, and the flexible filter body may have a flexible cleaning and/or sealing part attached to a portion of the flexible filter body for closing the opening of the coarse pre-filter body. The cleaning/sealing part assists in removing dust by scraping the interior of the pre-filter body during filter cleaning, and provides an efficient seal between the pre-filter and particle-filter during operation of the vacuum cleaner.

The vacuum cleaner according to the invention may further comprise means for swirling the incoming air around the filter unit. This is advantageous since vacuumed dust is more evenly adhered around the circumference of the filter, which prevents some parts of the filter to be excessively clogged, which would lead to a substantial decrease of air flow through the vacuum cleaner.

According to the invention, any one of the housing, the dust container and the filter unit may comprise at least one air flow guiding vane for generating the swirling or cyclonic effect described above.

Any one of the dust container and filter may comprise a dust-trapping rib for causing dust to be trapped near a desired part of the filter unit, which aids in building up an even distribution of dust around the filter body.

The term “hand held vacuum cleaner” incorporates small vacuum cleaners intended for vacuum cleaning small surfaces. During operation the hand held vacuum cleaner is, as one unit, continuously carried or continuously moved over a surface being vacuum cleaned. It should be noted that the term “hand held vacuum cleaner” incorporates stick vacuum cleaners.

BRIEF DESCRIPTION OF THE DRAWINGS

Embodiments of the present invention will now be described, by way of example, with reference to the accompanying schematic drawings, in which.

DETAILED DESCRIPTION OF EMBODIMENTS

Figure 1:
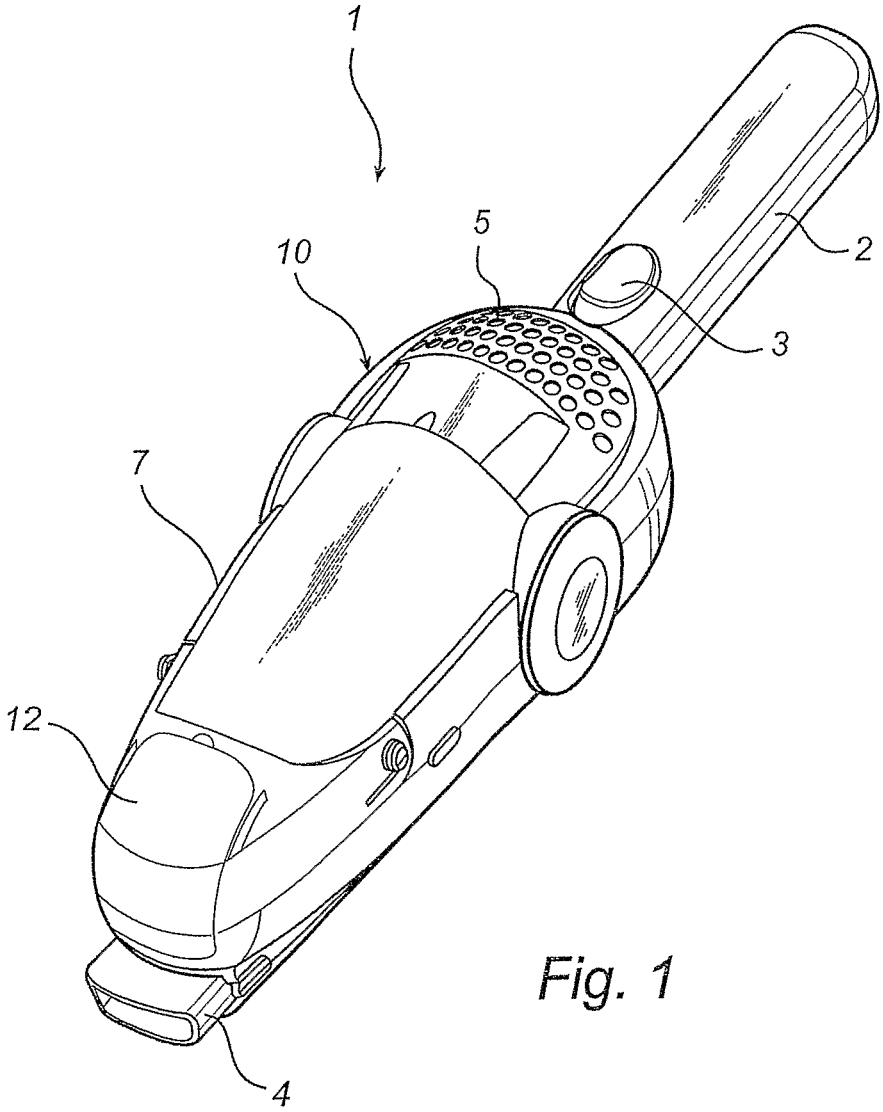
FIG. 1 is a perspective view of a hand held vacuum cleaner.
Figure 2:
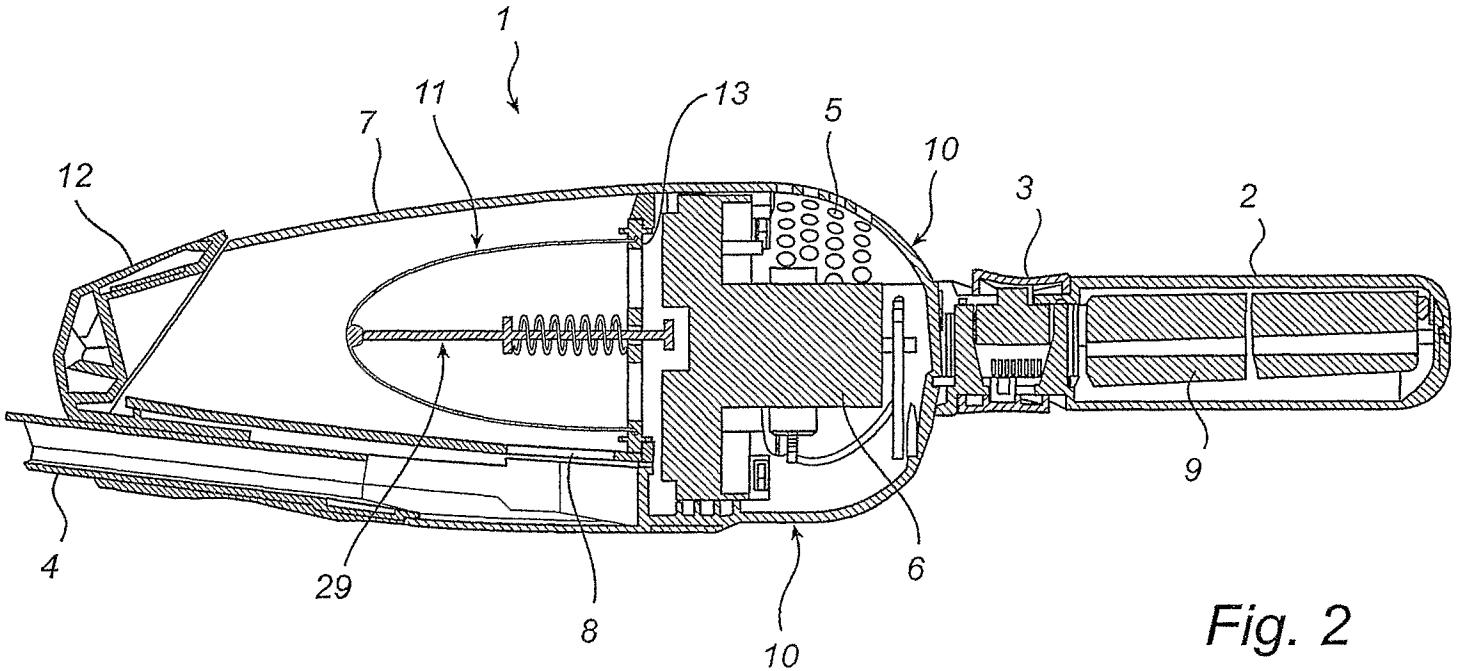
FIG. 2 is a cross-sectional view of the hand held vacuum cleaner of FIG. 1.
Figure 9:
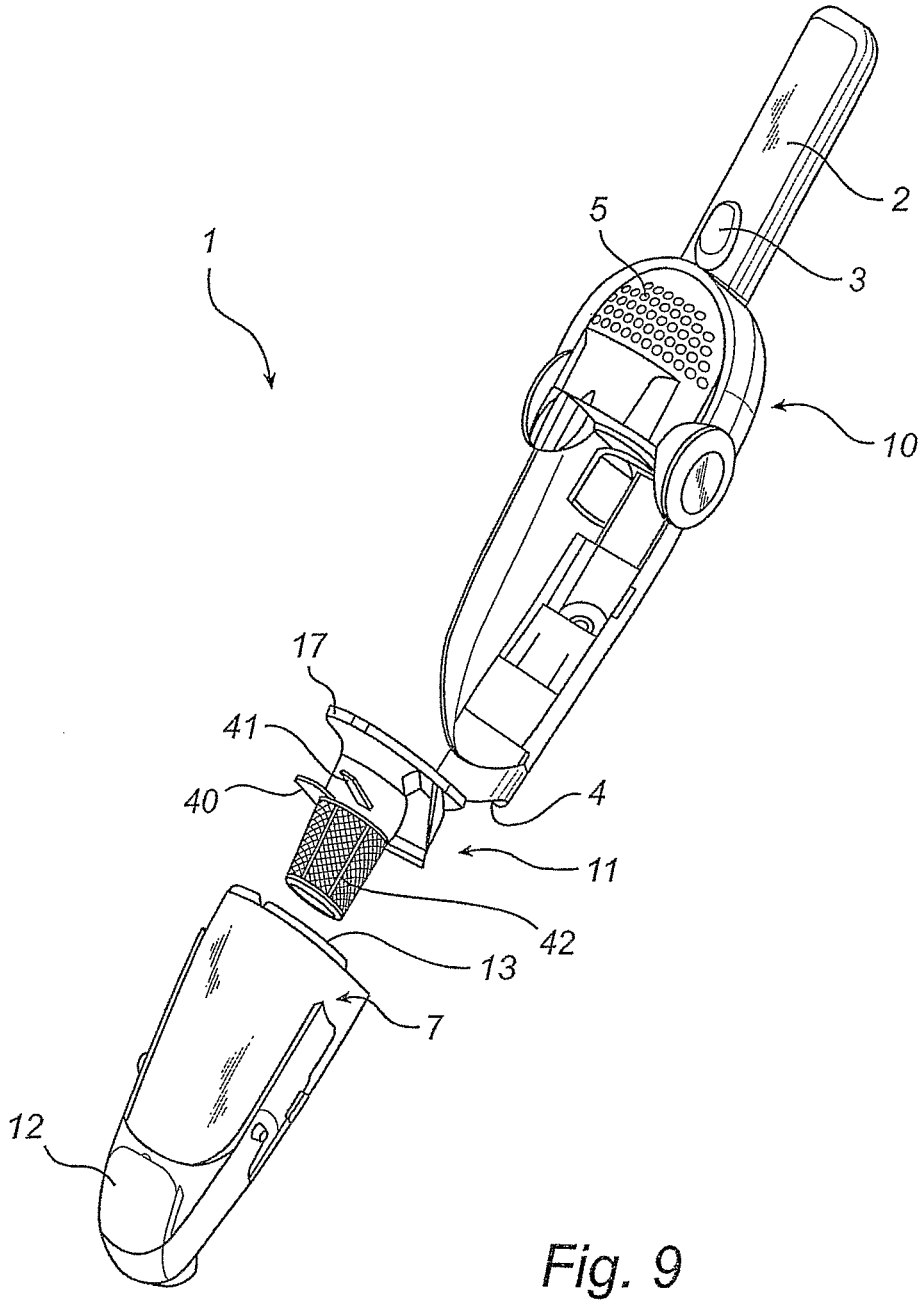
FIG. 9 is an exploded view of a hand held vacuum cleaner with a filter unit incorporating swirling means.

With reference to FIGS. 1, 2 and 9 a hand held vacuum cleaner 1 is illustrated. The vacuum cleaner 1 comprises a housing 10 having a handle 2, an on/off-switch 3 and an inlet 4 for suction of dust laden air. The suction is generated by means of a motor fan unit 6 arranged in the housing 10. When the vacuum cleaner 1 is operated, air flows from the inlet 4 of the vacuum cleaner 1, into an inlet opening 8 of a dust container 7, through a filter unit 11, past the motor fan unit 6, and finally the air exits the vacuum cleaner 1 through outlets 5.

The motor fan unit 6 is typically powered by batteries 9 arranged in the handle 2 and is turned on or off by means of the on/off-switch 3. Preferably the batteries 9 are rechargeable and preferably the housing 10 comprises a power-inlet and electrical circuits (not shown) for recharging the batteries 9.

As described above, dust laden air flows through the filter unit 11 during operation and thereby the air is filtered by the filter unit 11 which traps dust, fibers, hair, sand and other particles. Some of the sucked up particles adhere to the filter unit 11, but most are trapped in a lowermost part of the dust container 7. The dust container 7 is emptied, for example, by opening a lid 12 belonging to the dust container 7 and by allowing the dust to exit the lid opening, or by removing the dust container 7 from the housing 10 and allowing dust to escape from an opening 13 of the dust container 7.

Figure 3:
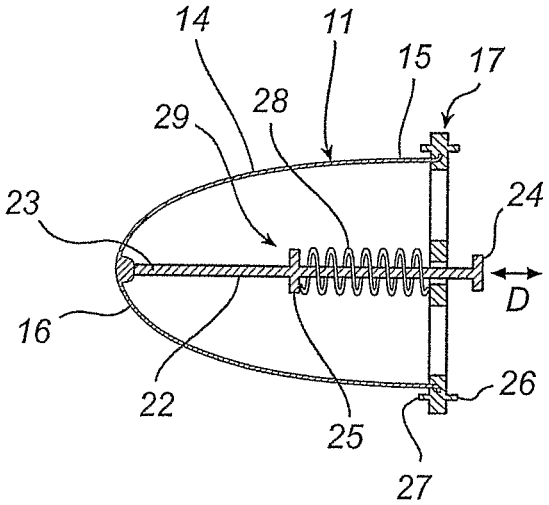
FIG. 3 is a cross-sectional view of a filter unit according to a first embodiment.
Figure 4:
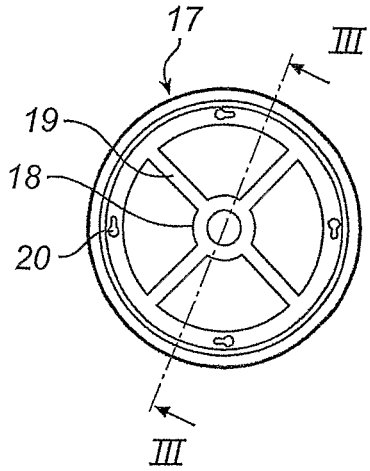
FIG. 4 is a side view of the filter unit of FIG. 3.

With reference to FIGS. 3 and 4, a filter unit 11 according to a first embodiment is illustrated. The filter unit 11 comprises an air permeable and flexible filter body 14 having the form of a tubular bag with its open end, or top portion 15, integrated with a filter attachment member 17. A dust removing means 29 comprising a rod 22 and a spring 28 is arranged inside the filter body 14, and an end portion 23 of the rod 22 is connected to a closed portion 16 of the filter body 14. The rod 22 is supported by a support part 18 integrated with the filter attachment member 17 via at least one arm 19. Preferably the support part 18 forms a hole for the rod 22. The filter body 14 is straightened by a biasing force applied by the spring 28 which is arranged around the rod 22 between a rod protrusion 25 and the support part 18 of the attachment member 17.

The attachment member 17 comprises holes 20 that are configured to receive therethrough corresponding pegs (not shown) that extend from the housing 10 or from the dust container 7 in order to form a bayonet joint. Resilient sealing members 26, 27 are arranged on the attachment member 17 for providing an air tight seal between the housing 10 and/or the dust container 7.

The attachment member 17 may also be connected by connecting the dust container 7 to the housing 10 and therebetween fitting and pressing the attachment member 17, or the attachment member 17 may be attached to the housing 10 or the dust container 7 by an interference fit or snap fit associated with the respective connecting parts.

Figure 5:
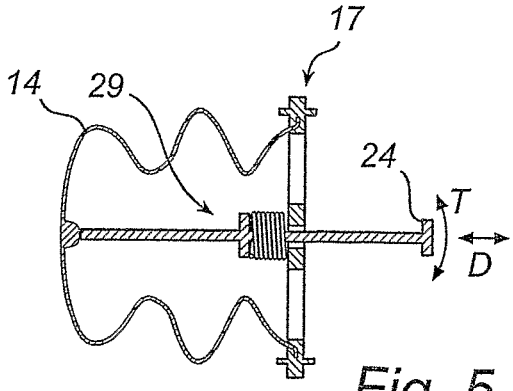
FIG. 5 is a view of the filter unit of FIG. 3 in a contracted state.

Preferably, the filter unit 11 is attached to the dust container 7 and when the filter unit 11 is to be cleaned the dust container 7 is removed from the housing 10 with the filter unit 11 still attached. Subsequently a top portion 24 of the rod 22 is moved in the direction of the arrow D for collapsing and expanding the filter unit 11, or more specifically, contracting and straightening the flexible filter body 14 as illustrated in FIG. 5. During this operation dust falls off the filter unit 11 and, since the filter unit 11 is still attached to the dust container 7, into the dust container 7 without spreading dust to the surroundings. Thereby, the filter unit 11 is cleaned.

The outer surface of the filter body 14, i.e. the surface facing the interior of the dust container 7, is preferably sleek for preventing hair and fibers from adhering to the filter body 14. Any known filter material with a sleek surface may be used for manufacturing the filter body 14.

Figure 6:
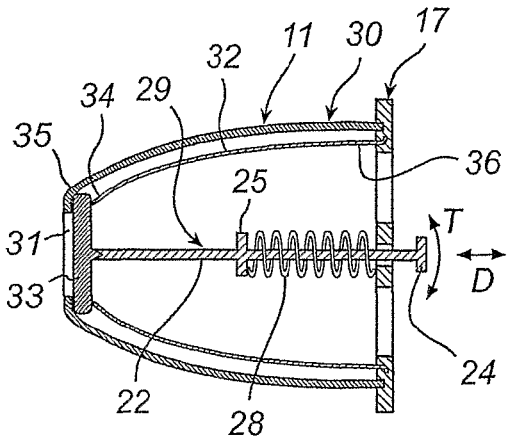
FIG. 6 is a cross-sectional view of a filter unit according to a second embodiment.

With reference to FIG. 6 a filter unit 11 according to a second embodiment is illustrated. The filter unit 11 comprises an air permeable and flexible fine particle-filter body 32 having the form of a tubular bag with its open end, or top portion 36, integrated with a filter attachment member 17. A flexible cleaning and/or sealing part 33 is attached to a closed portion 34 of the particle-filter body 32. The filter unit 11 further comprises a coarse pre-filter body 30 which has an opening 31 in an end portion, encloses the particle-filter body 32 and is connected to the attachment member 17. It should be noted that the coarse pre-filter body 30 filters large particles such as hair and fibers, while the particle-filter body 32 filters smaller particles that pass through the coarse filter 30.

Preferably the coarse pre-filter body 30 is detachable from the attachment member 17, and the coarse filter body 30 may incorporate a separate attachment member (not shown) for attachment to any of the attachment member 17, the housing 10 and the dust container 7.

A dust removing means 29 comprising a rod 22 and a spring 28 is arranged inside the particle-filter body 32, and the inner portion of the rod 22 is connected to the closed portion 34 of the particle-filter body 32 in a manner corresponding to the filter according to the first embodiment. The spring 28 presses the cleaning/sealing part 33 towards the lower part of the coarse pre-filter body 30 and thus seals the opening 31 during operation of the vacuum cleaner 1.

Figure 7:
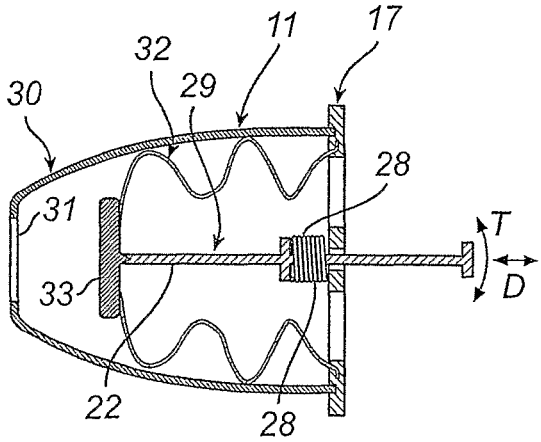
FIG. 7 is a view of the filter of FIG. 6 in a contracted state.

The filter unit 11 according to the second embodiment is attached to the dust container 7 or the housing 10 in a manner similar to the attachment of the first embodiment of the filter unit 11. When the filter unit 11 is to be cleaned the dust container 7 is removed from the housing 10 with the filter unit 11 still being attached. The top portion 24 of the rod 22 is then moved in the direction of the arrow D for collapsing and expanding the filter unit 11, or more particularly, contracting and straightening the particle-filter body 32 as illustrated in FIGS. 6-7. During this operation dust falls off the particle-filter 32, out through the opening 31 and into the dust container 7.

If particles of dust are adhered to the interior of the pre-filter 30, the interior may be scraped by the cleaning/sealing part 33. To facilitate this operation there is an optional clearance between the filter attachment member 17 and the rod 22 to allow slight tilting of the rod along direction T.

Figure 8:
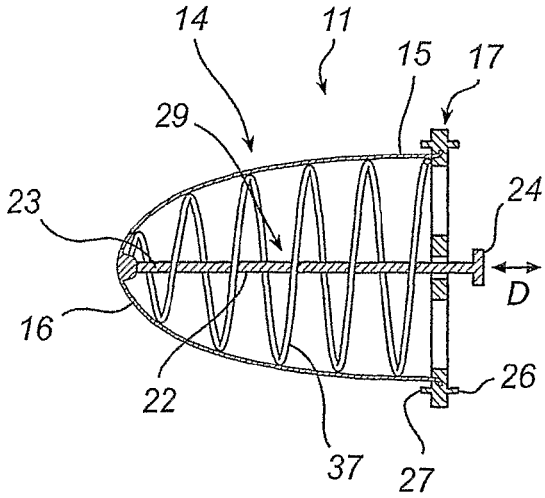
FIG. 8 is a cross-sectional view of a filter unit according to a third embodiment.

FIG. 8 illustrates a filter unit 11 according to a third embodiment. The filter unit 11 comprises a spring 37 arranged inside the filter body 14 to support the filter body 14. The spring 37 is at one end connected to a bottom portion 16 of the filter body 14 and is at its other end connected to the attachment member 17. Preferably the spring 37 has a conical shape corresponding to the straightened shape of the filter body 14, as illustrated in the figure. The spring 37 "fills" the inner space defined by the filter body walls.

The rod 22 of the third embodiment may be omitted and replaced by a weight (not shown) arranged in a bottom portion 16 of the filter body 14. In this case the filter unit 11 is to be shaken for contracting and straightening the filter body 14. Such a weight may be used in any combination of the first and second embodiment.

The spring 37 according to the third embodiment may also be combined with any of the filters according to the first and second embodiment. The spring 28 of the second embodiment may, of course, be omitted to provide yet another embodiment where the spring 37 according to the third embodiment is arranged within the particle-filter body 32, and where the spring 37 is connected to the bottom portion 34 of the particle-filter body 32 and to the attachment member 17. Of course, the rod 22 of the second embodiment may be omitted and replaced by a weight (not shown) arranged in a bottom portion 34 of the particle-filter body 32.

With reference to FIGS. 2 and 9, the filter comprises a radial wall 40 for preventing dust from exiting through the opening 8 of the dust container 7 when the vacuum cleaner 1 is held with its opening 4 in an upward direction. An air-flow guiding vane 41 is arranged on the exterior of the filter unit 11 for creating an effect where air is swirled around the filter unit 11 during operation. Several air-flow guiding vanes may be arranged, and the vanes may also be arranged on the interior of the dust container 7 or on the housing 10. A support frame 42 may also be arranged to provide predetermined outer boundaries for the filter unit 11.

To cause dust to get stuck between the filter unit 11 and the dust container 7, a rib 40 is integrated with the filter unit 11 and extends radially towards the dust container 7.

A suitable known material is selected for the filters and bodies described above, such as a plastic material for the coarse pre-filter 30 and a fiber or web-based material for the particle-filter 14, 32.

The filter body or bodies and filter attachment member are integrated, for example, by bonding, gluing, melting or sewing the filter body to a surface of the attachment member, by enclosing the open end of the filter body in the attachment member, by clamping or melting the attachment member to the filter body. Preferably the filter body and attachment member are circular as illustrated in the figures. However, any of the filter body and attachment member may, for example, be rectangular, triangular or have any other suitable shape.

The attachment member may have any suitable shape for attachment to the dust container and for support of the dust cleaning means and may, for example, comprise a disc with attachment holes and a support hole for the cleaning means. Preferably the attachment member is extruded, and preferably made of a plastic material such as polyethylene or any other similar material.

The spring may be replaced by a suitable elastic element that will provide a corresponding function. It is also possible to connect an elastic element, such as a spring or a rubber string, to the attachment member and the top portion of the rod.

The dust container may be an integrated part of the vacuum cleaner, and the inlet of the vacuum cleaner may comprise the dust container inlet.

Furthermore, the described spring is only one example of means for straightening the respective filter bodies. Other means for straightening the filter comprise an interference fit or a snap-in fitting between the rod and the filter attachment member, since this would fix the rod to the attachment member and thus provide a desired, straightened shape of the filter body. When the filter is to be cleaned, or the rod reciprocated, the interference is manually overcome by a user, or the snap-in fitting is opened by the user.

Another way of straightening the respective filter bodies comprises arranging a part of the housing, such as a protection element for the motor fan unit, to continuously exert a pressure on the top portion of the rod when the housing and the dust container are connected.

According to particular aspect of this concept, an exchangeable filter unit for a vacuum cleaner is provided, which filter comprises a flexible filter body integrated with a filter attachment member, and dust removing means configured to collapse and expand the flexible filter body in response to a force applied to the dust removing means.

The exchangeable filter unit may incorporate any of the embodiments of the filter and dust removing means of the vacuum cleaner described above.

The invention claimed is:

1. A vacuum cleaner comprising:

a housing comprising a dust container having an inlet for dust laden air;

a filter unit comprising a flexible filter body;

a motor fan unit for generating a flow of air through the inlet, and through the filter unit; and dust removing means configured to agitate the flexible filter body in response to a force applied to the dust removing means, wherein the dust removing means comprises:

a rod connected to a portion of the filter unit, the rod being retractable in a direction away from the filter unit to thereby collapse the filter unit upon retraction of the rod, and an elastic element that exerts the force to agitate the flexible filter body, the force acting on the rod to expand the flexible filter body.

2. The vacuum cleaner of claim 1, wherein the dust removing means is configured to be manually operated.

3. The vacuum cleaner of claim 1, wherein the filter unit comprises an attachment member for attaching the filter unit to at least one of the housing and the dust container.

4. The vacuum cleaner of claim 3, wherein the attachment member supports the dust removing means.

5. The vacuum cleaner of claim 3, wherein the filter unit and the dust removing means form an integrated and exchangeable filter assembly.

6. The vacuum cleaner of claim 3, wherein the attachment member comprises an annular member that is molded together with an open end of the flexible filter body.

7. The vacuum cleaner of claim 1, wherein the flexible filter body is generally tubelike and has a closed end and an open end opposite the closed end.

8. The vacuum cleaner of claim 1, wherein the flexible filter body has a surface facing the interior of the dust container that is configured to prevent hair and fibers from adhering to said surface.

9. The vacuum cleaner of claim 1, further comprises a coarse pre-filter body at least partially encompassing the flexible filter body, wherein the coarse pre-filter body comprises part of the filter unit.

10. The vacuum cleaner of claim 9, wherein the coarse pre-filter body has a baglike shape having an open end, and wherein the flexible filter body is arranged inside the coarse pre-filter body such that an open end of the flexible filter body is located at the open end of the coarse pre-filter body.

11. The vacuum cleaner of claim 9, wherein the coarse pre-filter body has a first opening generally adjacent an open end of the flexible filter body, and a second opening opposite the first opening, the second opening being adapted to pass dust that has been removed from the filter body by means of the dust removing means.

12. The vacuum cleaner of claim 11, further comprising a flexible sealing member attached to a bottom portion of the flexible filter body and adapted to close the second opening of the coarse pre-filter body during vacuum cleaning operation.

13. The vacuum cleaner of claim 12, wherein the flexible sealing member is also adapted to clean an interior surface of the flexible filter body.

14. The vacuum cleaner of claim 12, wherein the rod is adapted to tilt side to side.

15. The vacuum cleaner of claim 1, further comprising means for swirling the flow of air through the inlet around the filter unit.

16. The vacuum cleaner of claim 1, wherein at least one of the housing, the dust container and the filter unit comprises at least one air flow guiding vane for swirling the flow of air through the inlet around the filter unit.

17. The vacuum cleaner of claim 1, wherein at least one of the dust container and the filter unit comprises a dust-trapping rib.

18. The vacuum cleaner of claim 1, wherein the dust removing means is configured to collapse and expand the flexible filter body in response to a force applied to the dust removing means.

19. The vacuum cleaner of claim 1, wherein the vacuum cleaner comprises a hand held vacuum cleaner.

* * * * *

UNITED STATES PATENT AND TRADEMARK OFFICE

CERTIFICATE OF CORRECTION

PATENT NO. : 8,424,154 B2
APPLICATION NO. : 12/296864
DATED : April 23, 2013
INVENTOR(S) : Jonas Beskow et al.

It is certified that error appears in the above-identified patent and that said Letters Patent is hereby corrected as shown below:

On the Title Page, item (30) should read

(30) Foreign Application Priority Data

April 10, 2006 (SE) 0600820-5

Signed and Sealed this
Sixth Day of August, 2013

Teresa Stanek Rea
*Acting Director of the United States Patent and Trademark Office*